United States Patent [19]

Frey

[11] Patent Number: 5,038,418

[45] Date of Patent: Aug. 13, 1991

[54] BATHROOM WASTE COLLECTION AND DISPOSAL UNIT

[75] Inventor: William J. Frey, Louisville, Ky.

[73] Assignee: Zoeller Company, Louisville, Ky.

[21] Appl. No.: 266,837

[22] Filed: Nov. 3, 1988

[51] Int. Cl.[5] ..... E03D 1/00; E03D 5/01

[52] U.S. Cl. ..... 4/321; 4/364; 4/460; 417/40

[58] Field of Search ..... 4/321, 322, 323, 460, 4/593, 613, 421, 422, 360, 364; 264/310; 405/210, 53; 220/18, 72, 71; 108/24; 417/40

[56] References Cited

U.S. PATENT DOCUMENTS

| | | | |
|---|---|---|---|
| 1,743,459 | 1/1930 | Kjekstad | 220/71 |
| 1,757,923 | 5/1930 | Russell | 220/71 |
| 2,222,595 | 11/1940 | Regester | 417/40 |
| 2,409,245 | 10/1946 | Black | 417/40 X |
| 2,820,568 | 1/1958 | Zick et al. | 220/71 X |
| 3,124,265 | 3/1964 | Bertels | 220/71 X |
| 3,316,845 | 5/1967 | Schumann | 417/40 |
| 3,442,219 | 5/1969 | Fitzgerald | 417/40 |
| 3,561,019 | 2/1971 | Roland | 4/593 |
| 3,677,432 | 7/1972 | Kaempen | 220/71 X |
| 4,187,561 | 2/1980 | Bogan | 4/460 X |
| 4,231,482 | 11/1980 | Bogan | 220/5 A |
| 4,274,548 | 6/1981 | Schneider | 220/72 |
| 4,377,875 | 3/1983 | Brubakken | 4/665 |
| 4,551,869 | 11/1985 | Whitney | 4/592 |
| 4,634,028 | 1/1987 | de Larosiere | 222/464 |
| 4,704,747 | 11/1987 | Brubakken et al. | 4/321 |

*Primary Examiner*—Henry J. Recla
*Assistant Examiner*—R. M. Fetsuga
*Attorney, Agent, or Firm*—Jon C. Winger

[57] ABSTRACT

A bathroom waste collection and disposal unit for mounting on a floor of an enclosure includes a tank of unitary construction having a horizontal portion defining a refuse reservoir and a vertical portion open to the horizontal portion for refuse gases and to accommodate a pump. A toilet is mounted on the top surface of the horizontal portion in fluid communication with the reservoir of the horizontal portion of the tank. The horizontal portion includes a plurality of columns within the reservoir extending between the floor and top wall of the horizontal portion. The tank also includes a baffle housing for enclosing the float of the refuse pump to meter the rate of flow of water flowing away from the pump float as the pump is actuated to discharge refuse from the reservoir.

10 Claims, 2 Drawing Sheets

BATHROOM WASTE COLLECTION AND DISPOSAL UNIT

BACKGROUND OF THE INVENTION

The present invention relates to self-contained bathroom waste collection and disposal units, and refuse tanks for such units.

Self-contained bathroom waste collection and disposal units are known, per se, and have particular utility for constructing bathrooms in locations not originally outfitted for such bathrooms. For example, such bathroom waste collection and disposal units are often used in the construction of bathrooms in a basement or on a concrete slab.

Examples of previously known self-contained bathroom waste collection and disposal units are shown in U.S. Pat. No. 3,582,995 issued on Jun. 8, 1971 to Enenstein; U.S. Pat. No. 4,377,875 issued in March, 1983 to Brubakken; and U.S. Pat. No. 4,704,747 issued on Nov. 10, 1987 to Brubakken.

Typically, the known self-contained bathroom waste collection and disposal units include a refuse tank fabricated of fiberglass which is non-corrosive. However, such fiberglass tanks are relatively time consuming and labor intensive to make and, therefore, relatively expensive.

Problems which must be addressed in such refuse tanks is that they must be made of a non-corrosive material, they must be gas tight and water tight, and they must be rigid enough to support the weight of a toilet and a person using it. Further, such tanks should also be relative light weight so that they can be easily moved by the people installing the bathroom unit to the location whereat it is to be installed.

The present invention recognizes these problems and provides a straightforward solution thereto.

SUMMARY OF THE INVENTION

The present invention provides a bathroom waste collection and disposal unit and a refuse tank therefor which is light weight yet rigid.

The present invention also provides a bathroom unit and tank of the class described which is less labor intensive to manufacture and, therefore, can be made on a high production basis.

More particularly, in one embodiment, the present invention provides a bathroom waste collection and disposal unit comprising a unitary seamless refuse tank having a horizontal portion defining a waste collection reservoir and a vertical portion for venting refuse gases; the horizontal portion of the tank including a floor, a front wall, a back wall, side walls and top wall; a plurality of spaced apart columns extending vertically within the reservoir between the floor and top wall of the horizontal portion and integral with the top wall and floor of the horizontal portion; and the vertical portion of the tank including a front wall, a back wall, side walls and a top wall.

BRIEF DESCRIPTION OF THE DRAWINGS

A better understanding of the present invention will be had with reference to the following description in conjunction with the accompanying drawings wherein like numerals refer to like parts throughout the several views and in which.

DETAILED DESCRIPTION OF THE PREFERRED EMBODIMENT

Figure 1:
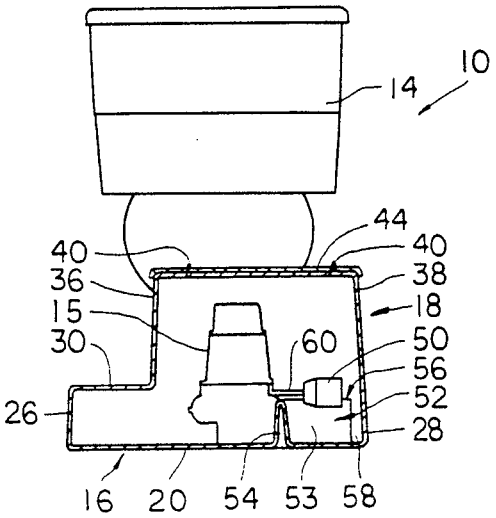
FIG. 1 is a rear view of the bathroom unit of the present invention partially in cross-section.
Figure 2:
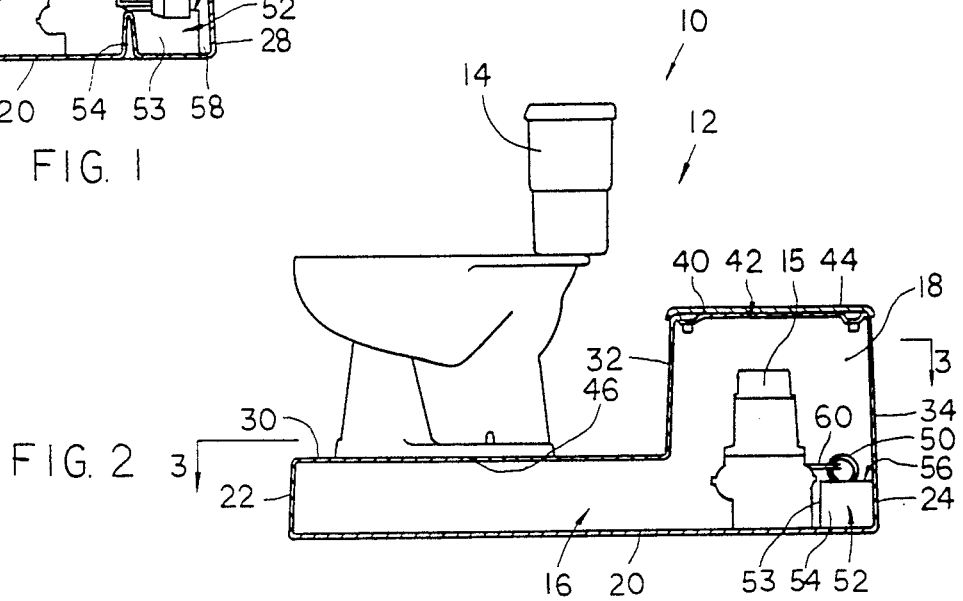
FIG. 2 is a side view of the bathroom unit of FIG. 1 partially in cross-section.
Figure 3:
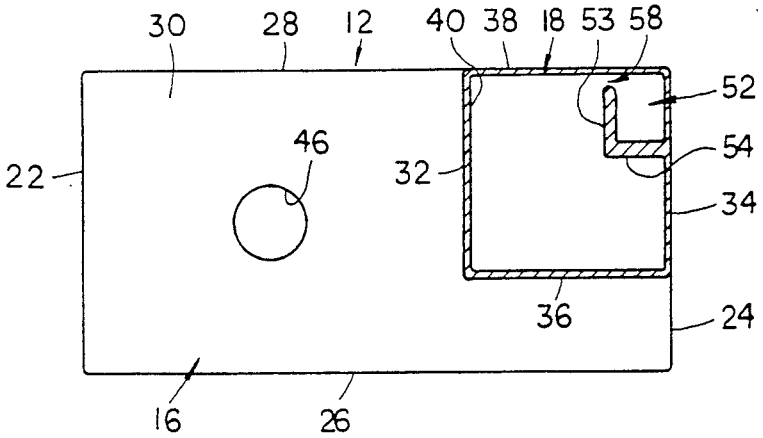
FIG. 3 is a top view of the tank of the present invention.

With reference to FIGS. 1 and 2, there is shown a bathroom waste collection and disposal unit, generally denoted as the numeral 10, which comprises a tank 12, and a toilet 14 mounted to and supported on the tank 12. The bathroom waste collection and disposal unit 10 is particularly well adapted for installation in existing rooms or room additions because it rests on the room floor and does not require modifications to the room floor. The tank 12 is provided with a waste pump 15 for pumping collected refuse including waste and water from the tank 12 for proper disposal thereof.

The tank 12 of the present invention provides a light weight yet strong construction which is capable of supporting the toilet 14 and a person using the toilet without flexing or distortion to the tank structure.

With reference to FIGS. 1–5, the tank 12 is of unitary seamless construction, so that it is gas tight and water tight, comprising a horizontal portion 16 defining a refuse collection reservoir and a vertical portion 18 open to the horizontal portion 16. The horizontal portion 16 includes a floor 20, a front wall 22, a back wall 24, side walls 26, 28, and top wall 30. As shown, the floor 20 and top wall 30 are each substantially flat, and are substantially parallel to each other. The vertical portion 18 includes a front wall 32, a back wall 34, side walls 36, 38, and an open top 40. As shown, the vertical portion 18 is positioned at the back end of the horizontal portion 16 and extends only part way across the width of the horizontal portion 16 with the front wall 32 of the vertical portion 18 extending upwardly from the top wall 30 of the horizontal portion 16, one side wall 36 also extending upwardly from the top wall 30 of the horizontal portion 16, the other side wall 38 extending upwardly from one side wall 28 of the horizontal portion 16, and the back wall 34 extending upward from the back wall 24 of the horizontal portion 16. However, it should be understood that the vertical portion 18 could extend entirely across the width of the horizontal portion 16. The top wall of the vertical portion 18 is closed by a removable cover 44 with a sealing fit. The top wall 30 of the horizontal portion 16 is formed with an opening 46 over which the toilet 14 is mounted for the deposit of refuse including waste and water into the refuse reservoir of the horizontal portion 16.

Figure 4:
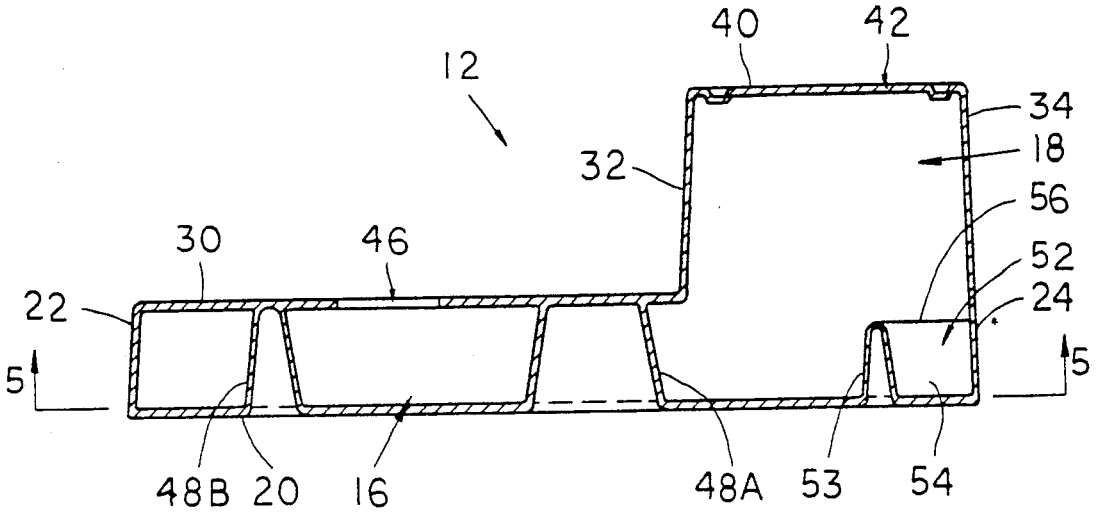
FIG. 4 is a cross-sectional side view of the tank of FIG. 3 as seen in the direction of arrows 4—4 in FIG. 5.
Figure 5:
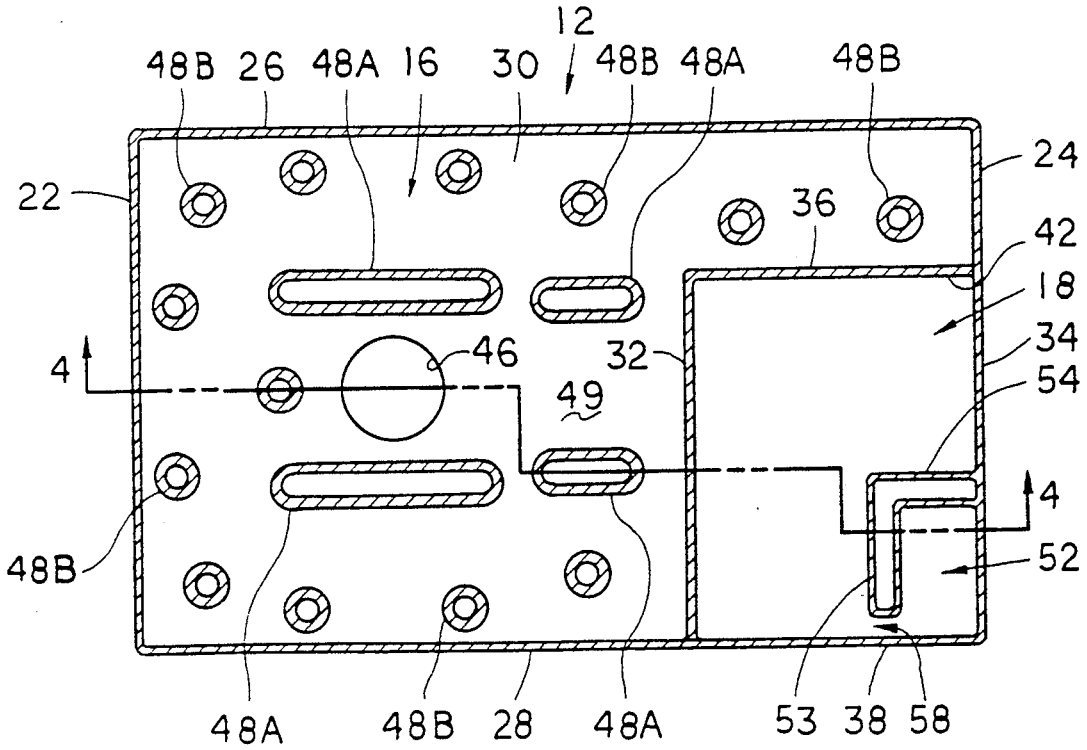
FIG. 5 is a cross-sectional bottom view of the tank of FIGS. 3 and 4 as seen in the direction of arrows 5—5 in FIG. 4.

With reference to FIGS. 4–5, the tank 12 is fabricated of a thermoplastic material such as, for example, polyethylene or polypropylene, which prior to the present invention was not considered to be a suitable material for such tanks 12 because thermoplastic material is not sufficiently rigid to withstand the weight of a toilet and person without substantial flexing and distorting. The tank 12 of the present invention comprises a plurality of columns 48 located inside the refuse reservoir of the horizontal portion 16 in spaced apart relationship across the width and length of the horizontal portion 16. As best seen in FIG. 5, the columns 48 are not necessarily all of the same transverse cross-sectional shape. As shown, columns 48A are elongated in transverse cross-section and are spaced to lateral sides of the longitudinal centerline of the horizontal tank portion 16 near the location of the toilet opening 46, and columns 48B are circular in transverse cross-section and are located near the perimeter of the horizontal tank portion 16. The columns 48 extend vertically between the floor 20 of the horizontal portion 16 and top wall 30 of the horizontal portion 16. The columns 48 are unitarily or integral with the horizontal portion floor 20 and horizontal portion top wall 30 and are fabricated of the same thermoplastic material as is the tank 12. As shown best in FIG. 5, the columns 48 are hollow and open to the horizontal portion floor 20. The columns 48 add sufficient structural rigidity to the horizontal portion 16, and particularly the horizontal portion top wall 30 to withstand the weight of the toilet 14 and person. More particularly, the elongated columns 48A are parallel to the longitudinal centerline of the horizontal tank portion 16 and spaced to opposite lateral sides of the longitudinal centerline by a distance approximately equal to the width of the base of the toilet 14 so that the toilet 14 will be supported directly by the columns 48A. It should be noted that the elongated columns 48A define a channel 49 extending from a location beneath the opening 46 to the pump 15 for directing refuse directly to the pump 15. The columns 48B are appropriately positioned to directly support the weight of a person whom may be standing on the top wall 30 of the horizontal portion 16.

With reference to FIGS. 1-2, the waste pump 15 is disposed in the reservoir defined by the horizontal portion 16. The pump 15 includes a float 50 which actuates the pump when the refuse in the reservoir of the horizontal portion 16 has reached a predetermined level so that the refuse will not overfill and occupy an air space to be maintained above the refuse in the horizontal portion 16 of the tank 12. As shown, the float 50 is located within a baffle housing 52 located in the horizontal tank portion 16 to control the movement of the float 50 as the refuse is being pumped out of the reservoir of the horizontal tank portion 16 by the waste pump 15. As shown in FIGS. 1-5, the baffle housing 52 includes two intersecting side walls 53 and 54 extending upwardly from the floor 20 of the horizontal portion 16 at one corner of the horizontal portion 16, for example, the corner defined by the side wall 28 and back wall 24 of the horizontal portion 16. The baffle housing side wall 53 is spaced from the horizontal portion side wall 28 to define a water outlet passage 58 from the interior of the baffle housing 52 into the reservoir, and the other baffle housing side wall 54 extends to the horizontal portion back wall 24 and is integrally attached thereto. The side walls 53 and 54 of the baffle housing 52 are unitary or integral with the horizontal portion floor 20 and are fabricated of the same thermoplastic material as in the tank 12.

As shown in FIG. 5, the baffle housing side walls 53 and 54 are hollow and open to the exterior side of the horizontal portion floor 20. The baffle housing side walls 53 and 54 terminate a distance below the elevation of the horizontal portion top wall 30 so that the top 56 of the baffle housing 52 is open and is spaced below the elevation of the horizontal portion top wall 30. The float 50 includes a switch which opens and closes in response to the level of the water in the baffle housing 52. Various suitable switches are known, and include, or example, a mercury switch and can be operatively associated with the pump 15 by an electrical cable 60. Thus, when the water in the baffle housing 52 reaches a predetermined level, the switch in the float 50 actuates the pump 15 to pump refuse from the reservoir in the horizontal tank portion 16. As the refuse is pumped from the reservoir of the horizontal tank portion 16, water will flow out of the baffle housing 52 through the outlet passage 58 into the reservoir at a slower flow rate than the rate at which the refuse is being pumped out of the reservoir of the tank portion 16. This controlled, diminished flow rate of water out of the baffle housing 52 causes the pump to continue to operate for a period of time after the pump has removed substantially all of the water and most of the waste from the reservoir of the horizontal tank portion 16. Because of this continued operation of the pump 15, additional time is provided, after substantially all of the water is removed from the reservoir, for residual waste to move to the inlet of the pump 15 from the areas of the reservoir most remote from the pump 15. Thus, the pump 15 will remove substantially all of the waste from the horizontal tank portion 16.

It is contemplated that the tank 12 can be formed by various molding or casting techniques such as rotary casting.

Appropriate vent conduits, refuse outlet conduits, and any supplemental refuse inlet conduits from for example a sink or shower installation can be connected to the tank 12 as required.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A bathroom waste collection and disposal unit comprising:

a unitary refuse tank having a horizontal portion defining a refuse collection reservoir, and a vertical portion open to the reservoir;

the horizontal portion of the tank comprising a floor, a front wall, a back wall, side walls, and a top wall; and, a plurality of spaced apart hollow columns located in the reservoir in spaced parallel apart array therein and extending between the floor of the horizontal portion and the top wall of the horizontal portion, each of the columns being integral with the interior side of the horizontal portion top wall so that the top wall closes the top end of the columns to reinforce the top wall and provide a smooth continuous horizontal portion top wall and integral with the horizontal portion bottom wall and wherein the top wall of the horizontal portion of the tank is formed with a toilet opening into the reservoir on the longitudinal centerline of the horizontal portion of the tank;

some of the columns are located to the opposite lateral sides of the longitudinal centerline of the horizontal portion of the tank adjacent the toilet opening; and, others of the columns are located near the perimeter of the horizontal portion of the tank.

2. A bathroom waste collection and disposal unit comprising:

a unitary refuse tank having a horizontal portion defining a refuse collection reservoir, and a vertical portion open to the reservoir;

the horizontal portion of the tank comprising a floor, a front wall, a back wall, side walls, and a top wall;

a plurality of spaced apart hollow columns located in the reservoir in spaced apart array therein and extending between the floor of the horizontal portion and the top wall of the horizontal portion, each of the columns being integral with the interior side of the horizontal portion top wall so that the top wall closes the top end of the column to reinforce the top wall and provide a smooth continuous horizontal portion top wall and integral with the horizontal portion bottom wall; and, a baffle housing for enclosing a float actuator of a pump disposed in the reservoir of the horizontal portion, and having an opening providing for liquid communication between the interior of the baffle housing and reservoir exterior of the baffle housing and sized for controlling the flow of liquid out of the baffle housing into the reservoir such that the flow of liquid through the opening is less than the rate of flow at which the pump operates.

3. The bathroom waste collection and disposal unit of claim 2, wherein the top of the baffle housing is open and at an elevation below the top wall of the horizontal portion of the tank.

4. The bathroom waste collection and disposal unit of claim 2, wherein the baffle housing comprises side walls integral with and extending upwardly from the floor of the horizontal portion of the tank.

5. The bathroom waste collection and disposal unit of claim 2, further comprising a refuse pump located in the reservoir outside of the baffle housing, a pump float located in the baffle housing, and means operatively interconnecting the pump and the float.

6. The bathroom waste collection and disposal unit of claim 1, wherein, the columns are hollow and open to the exterior side of the floor of the horizontal portion of the tank.

7. The bathroom waste collection and disposal unit of claim 1, comprising a toilet fixture supported on the top wall of the horizontal portion over the toilet opening and supported by the columns located to opposite lateral sides of the longitudinal centerline of the horizontal portion of the tank.

8. The bathroom waste collection and disposal unit of claim 1, wherein:

the columns located to opposite lateral sides of the longitudinal centerline of the horizontal portion of the tank are elongated in transverse cross-section and are oriented in parallel relationship to the longitudinal centerline of the horizontal portion of the tank defining a channel from a location beneath the toilet opening toward a pump located near the back wall of the tank.

9. The bathroom waste collection and disposal unit of claim 1, wherein:

the columns located to opposite lateral sides of the longitudinal centerline of the horizontal portion of the tank are elongated in transverse cross-section and oriented in parallel relationship to the longitudinal centerline of the horizontal portion of the tank; and, the other columns are generally circular in transverse cross-section.

10. The bathroom waste collection and disposal unit of claim 1, wherein the refuse tank and columns are fabricated of a thermoplastic material.

* * * * *